US005295768A

United States Patent [19]

Buchhorn et al.

[11] Patent Number: 5,295,768

[45] Date of Patent: Mar. 22, 1994

[54] FRICTION ROCK STABILIZER

[75] Inventors: Peter Buchhorn, New Lambton; David H. R. Starke, Eleebana, both of Australia

[73] Assignee: The ANI Corporation Ltd., Pyrmont, Australia

[21] Appl. No.: 953,078

[22] Filed: Sep. 29, 1992

[30] Foreign Application Priority Data

Aug. 10, 1992 [AU] Australia ..... PL4057

[51] Int. Cl.[5] ..... E21D 21/00

[52] U.S. Cl. ..... 405/259.3; 405/255.1

[58] Field of Search ..... 405/259.1, 259.3, 259.4, 405/302.1, 259.5, 259.6; 411/57, 60

[56] References Cited

U.S. PATENT DOCUMENTS

| | | | |
|---|---|---|---|
| 3,478,523 | 11/1969 | Reusser et al. | 405/302.1 |
| 4,265,571 | 5/1981 | Scott | 405/259.3 |
| 4,382,719 | 5/1983 | Scott | 405/259.3 |
| 4,395,161 | 7/1983 | Wilson et al. | 405/302.1 |
| 4,652,178 | 3/1987 | Kates et al. | 405/302.1 |

*Primary Examiner*—David H. Corbin

*Attorney, Agent, or Firm*—Ladas & Parry

[57] ABSTRACT

A collar for a friction rock stabilizer and a friction rock stabilizer incorporating such collar. The collar is shaped having a domed outer surface to allow improved alignment between the collar and a mine bearing plate used between the collar and the mine surface when the stabilizer tube is inserted in a bore in a mine roof or wall.

7 Claims, 3 Drawing Sheets

FRICTION ROCK STABILIZER

This invention relates to friction rock stabilisers and more particularly to devices and methods for securing such stabilisers in bore holes drilled in mine roofs or walls, or the like.

In the securing of a mine roof or a mine wall, it is common to use a large number of friction rock stabilisers. A conventional friction rock stabiliser is simply a tube of resilient steel material, the tube being split so as to be compressible for insertion into a pre-drilled bore in a mine roof or wall and to thereafter resile into contact with the bore wall. A segment of the aforesaid friction rock stabiliser is left protruding from the bore. A mine bearing plate is placed around the protruding end of the friction rock stabiliser and is secured to the mine roof or mine wall by a securing device which is conventionally in the form of a split ring, again of resilient steel material of circular cross section. Since the end of the friction rock stabiliser around which this securing split ring is located, is substantially cylindrical, the securing split ring is provided with an internal surface with is complementary to the outer surface of the friction rock stabiliser.

A weld joint is provided between the split ring and the tube.

The known split ring—tube arrangement specified above has been found to produce insufficient resistance to the surrounding rock in particular applications. If the friction rock stabiliser (tube) is installed at an angle other than 90° to the rock face, there will be misalignment between the mine bearing plate (washer) and the aforesaid split ring. This may arise due to an uneven mine wall or roof surface where the friction rock stabiliser is inserted or, in the event of a comparatively smooth horizontal mine roof surface, the stabiliser may be inserted at an angle other than 90° to this surface. This misalignment causes the aforesaid split ring to be point loaded, leading to a premature failure of the aforesaid weld and substantial consequential reduction of the support capabilities of the tube. When the friction rock stabiliser is not installed at 90° to the rock face, failure of the weld or the split ring commonly occurs, particularly in the vicinity of the split in the friction rock stabiliser (tube).

It is an object of this invention to ameliorate the aforesaid disadvantages of known friction rock stabilisers.

This invention in one broad form provides a collar adapted to be secured by welding to a friction rock stabiliser tube, said collar having an internal surface adapted to abut the outer surface of said tube, said collar internal surface diameter being substantially equal to the external diameter of said tube in its relaxed state, said collar having an outer surface adapted for location adjacent a mine bearing plate used in conjunction with said friction rock stabiliser tube, said collar outer surface or the weld by which said collar is affixed to said tube being shaped to facilitate alignment of said collar or said weld with a mine bearing plate when said tube is inserted in a bore in a mine roof or wall.

It is preferred that the collar outer surface, in section, be of frusto-circular segmental shape. Indeed, a preferred shape for the collar outer surface is frusto-hemispherical or frusto-part-hemispherical.

The invention in a further broad form provides, in combination, a friction rock stabiliser tube with a collar, as defined above, adapted for welding thereto.

By way of example only, an exemplary embodiment of the prior art together with exemplary embodiments of the current invention, will now be described with reference to the accompanying drawings wherein.

Figure 1:
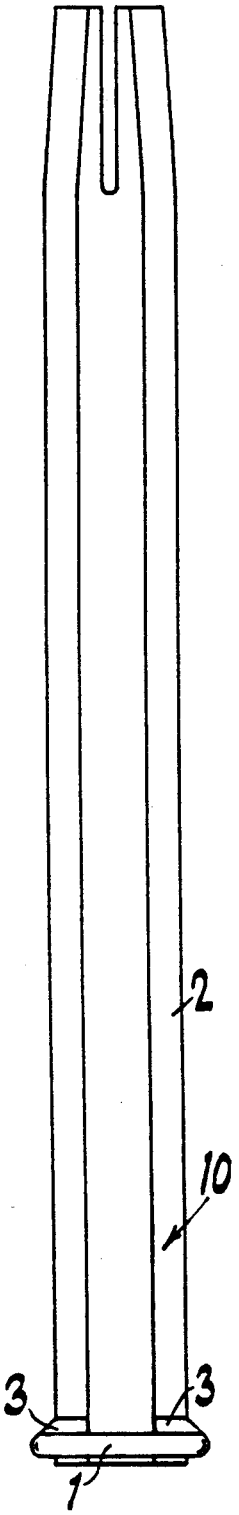
FIG. 1 PRIOR ART
FIG. 1 is a front view of a known friction rock stabiliser device.
Figure 1A:
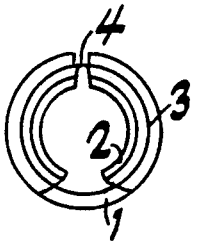
FIG. 1A PRIOR ART
FIG. 1A is a section view of the end portion of the friction rock stabiliser of FIG. 1.
Figure 1B:
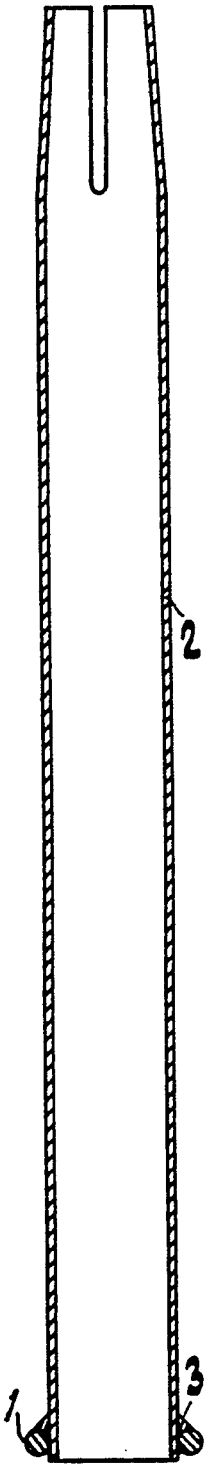
FIG. 1B PRIOR ART
FIG. 1B is a section view of the device of FIG. 1.

In the drawings, known friction rock stabiliser shown generally at 10 in FIG. 1 includes elongate tube 2 which, at its end which protrudes beyond the bore hole in a mine roof, or the like, in which the tube is installed, is surrounded by ring 1 which is split at 4. Split ring 1 is welded as at 3 to tube 2. It will be noted that split 4 in ring 1 is located diametrically opposite the split in tube 2.

Figure 2:
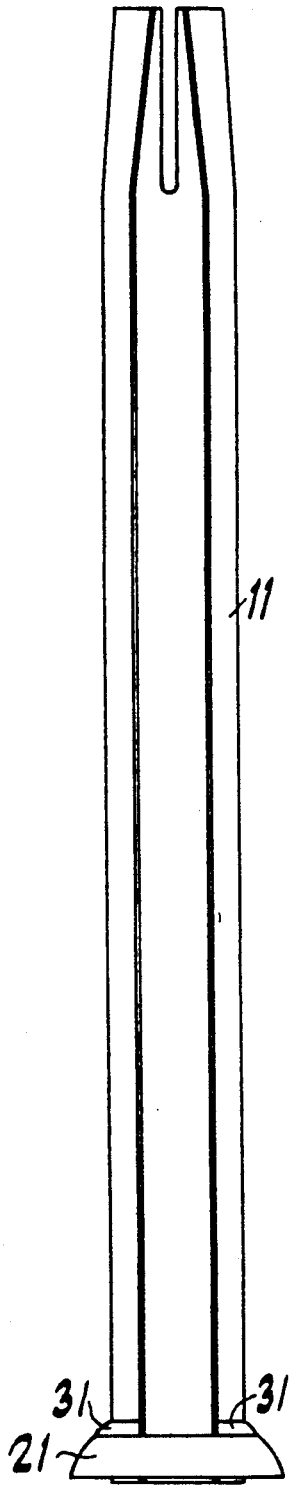
FIG. 2 is a front view of a first form of the friction rock stabiliser of this invention.
Figure 2A:
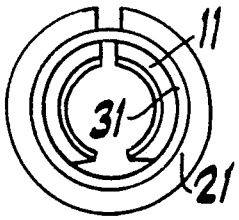
FIG. 2A is a plan view from below of the stabiliser of FIG. 2.
Figure 2B:
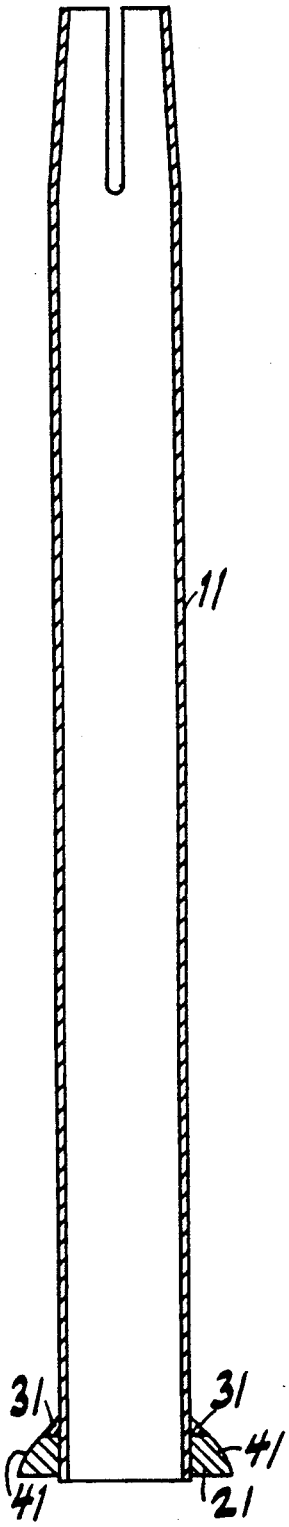
FIG. 2B is a broken section view of the friction rock stabiliser of FIG. 2.

In the device of this invention, longitudinal tube 11 is provided with collar 21 welded at 31 to tube 11. In the section drawing of FIG. 2B it can be seen that the surface 41 of collar 21 is arcuate so that collar 21 has an outer surface which is frusto-hemispherical or frusto-spherical segmental in nature.

The arcuate surface of collar 21 allows a much improved contact between collar 21 and a mine bearing plate in circumstances where the plane of the mine bearing plate is not normal to the axis of the tube, as frequently occurs in friction rock stabiliser installations where the roof or wall surface in which the tube is installed is uneven or where the tube is installed at an angle to that roof or wall.

Figure 3:
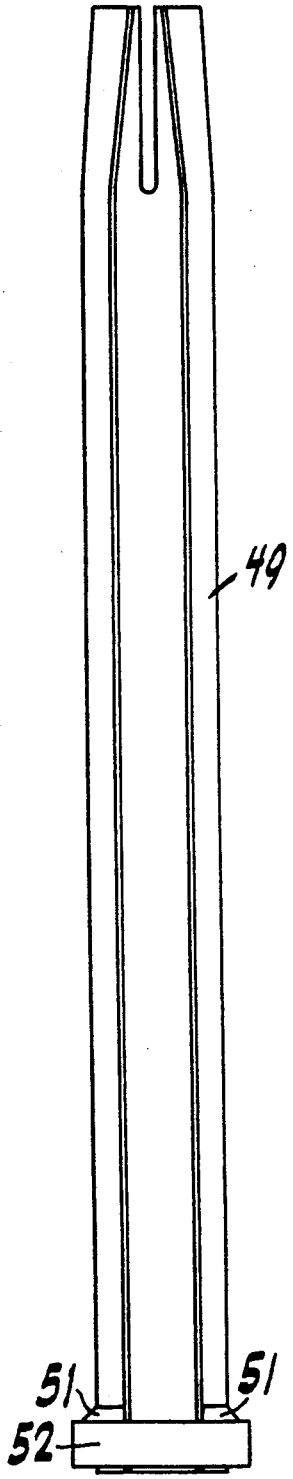
FIG. 3 is a front view of a further form of the friction rock stabiliser of this invention.
Figure 3A:
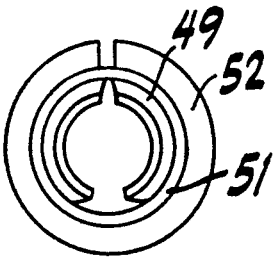
FIG. 3A is a plan view from below of the stabiliser of FIG. 3.
Figure 3B:
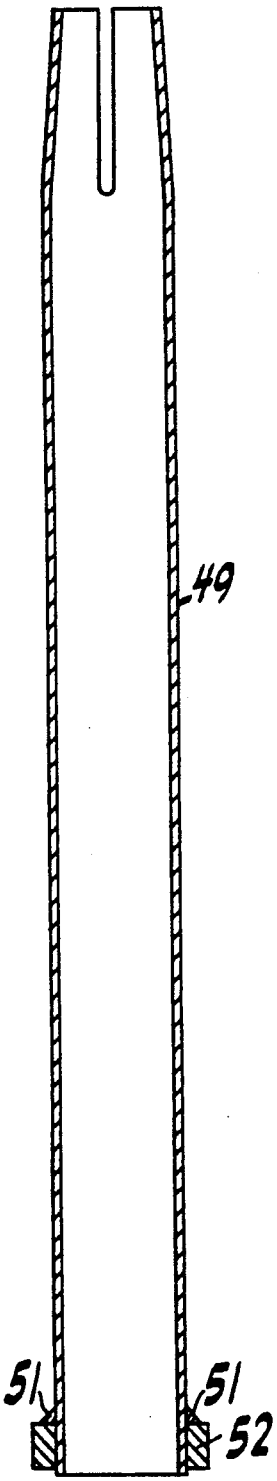
FIG. 3B is a broken section view of the friction rock stabiliser of FIG. 3.

The variation of the friction rock stabiliser of this invention depicted in FIGS. 3, 3A and 3B involves the use of a thrust ring 52 of rectangular cross-section with a width to depth ratio of two or more. This reduces the risk of failure of the ring 52 and its weld 51 to tube 49, but limits the degree of angularity afforded by the preferred from of FIGS. 2, 2A and 2B.

What we claim is:

1. A collar to be secured by welding to a friction rock stabilizer tube, said collar having an internal surface for abutting and being affixed to an outer surface of the tube, and wherein said collar having an internal surface diameter which is substantially equal to an external diameter of said tube when said tube is in a relaxed state, said collar having an outer surface for location adjacent to a mine bearing plate used in conjunction with said friction rock stabilizer tube, said outer surface having a substantially continuous arcuate shape to facilitate alignment of said collar with said mine bearing plate when said tube is inserted in a bore in a mine roof or wall.

2. A collar as defined in claim 1 wherein a weld securing the collar to the tube has a substantially continuous arcuate shape.

3. A collar as defined in claim 1 having an outer surface of frusto-circular segmental shape.

4. A collar as defined in claim 1 having an outer surface of frusto-hemispherical shape.

5. A collar as defined in claim 1 having a domed outer surface.

6. A collar as defined in claim 1 comprising a cylindrical thrust ring with a central axial opening to accommodate said tube, and a weld joint to secure said ring to said tube, said weld joint having a substantially continuous arcuate outer surface.

7. A collar as defined in claim 1 having an outer surface of frusto-part-hemispherical shape.

* * * * *